US005334904A

United States Patent [19]

Kramer

[11] Patent Number: 5,334,904

[45] Date of Patent: Aug. 2, 1994

[54] COMPACT DISC CASE

[76] Inventor: Dale C. Kramer, Nugent Road, P.O. Box 370, Port Colborne, Ontario, Canada, L3K 1B7

[21] Appl. No.: 820,763

[22] Filed: Jan. 15, 1992

[30] Foreign Application Priority Data

Jan. 16, 1991 [GB] United Kingdom ..... 9100979
Aug. 20, 1991 [GB] United Kingdom ..... 9117946

[51] Int. Cl.[5] ..... A47B 81/06

[52] U.S. Cl. ..... 312/9.57; 312/111; 206/387

[58] Field of Search ..... 312/107, 111, 9.14, 312/9.11, 9.16, 9.17, 9.26, 9.47, 9.48, 9.57; 206/309, 444, 387

[56] References Cited

U.S. PATENT DOCUMENTS

| | | | |
|---|---|---|---|
| Re. 30,184 | 1/1980 | Ackeret | 312/9.57 |
| 3,899,229 | 8/1975 | Ackeret . | |
| 4,239,109 | 12/1980 | Nielsen | 312/9.57 |
| 4,275,943 | 6/1981 | Gelordi | 312/9.57 |
| 4,641,747 | 2/1987 | Mestdagh et al. . | |
| 4,702,369 | 10/1987 | Philosophe | 312/9.48 |
| 4,705,166 | 11/1987 | Ackeret | 206/3.09 |
| 4,771,887 | 9/1988 | Nehl | 312/9.57 |
| 4,783,361 | 4/1988 | Ackeret . | |
| 4,817,792 | 4/1989 | Slefert . | |
| 4,819,802 | 4/1989 | Gutierrez | 312/9.57 |
| 4,838,422 | 6/1989 | Gregerson | 206/444 |
| 4,844,564 | 7/1989 | Price, Sr. et al. . | |
| 5,154,291 | 10/1992 | Sur | 312/9.11 |

FOREIGN PATENT DOCUMENTS

| | | | |
|---|---|---|---|
| 856608 | 11/1970 | Canada | 312/9.48 |

*Primary Examiner*—Peter M. Cuomo
*Assistant Examiner*—Flemming Saether
*Attorney, Agent, or Firm*—Sim & McBurney

[57] ABSTRACT

A storage device for compact disc trays, each of the trays having a front surface and a rear surface and a pair of side ledges extending substantially from the rear surface to the front surface and terminating in respective notches adjacent to the front surface. The storage device comprises a plurality of housing elements, each of the housing elements includes a rear wall and two side walls defining a rectangular space for receiving one of the compact disc trays. A spring is disposed adjacent the rear wall for applying a compressive force to the rear surface of the compact disc tray for urging the tray out of the space. A latch projects from one of the two side walls for releasably engaging one of the notches on the tray, thereby retaining the tray in the housing element against the compressive spring force.

19 Claims, 10 Drawing Sheets

10
12
14
16
18
20
22
23
24
25
26
29
30
32
34

COMPACT DISC CASE

FIELD OF THE INVENTION

The present invention relates in general to storage devices, and more particularly to a modular storage device for compact discs, or similar circular recorded media elements.

BACKGROUND OF THE INVENTION

Compact discs are sold in a standard flat box or case which has a hinged lid closure. One of the problems with compact discs is that it is always necessary to employ two hands to remove the disc from the case, or to restore the discs to the case which can be undesirable, for example, when operating a motor vehicle.

According to the prior art, storage devices have been provided for recorded media. U.S. Pat. Nos. 4,641,747; 4,738,361 and 4,817,792 each disclose a storage container comprising a receptacle and specially designed tray for holding the recorded media and adapted to slide in and out relative to the receptacle. These prior art containers are of complex construction necessitating the use of a proprietary tray for holding the compact disc or other recorded media. Furthermore, the design of these prior art containers does not admit of simple modular expansion to add additional single storage receptacles.

SUMMARY OF THE INVENTION

In accordance with the present invention, there is provided a novel form of housing for compact discs, or similar rigid disc-like recorded or recording media, which is modular in character, and hence permits multiple ones of such units to be assembled together. The structure of the invention employs the tray portion of the conventional compact disc case but discards the lid portion. The tray portion then is received in an open topped housing structure by sliding through an open end along guides against resilient spring action to a locked position. By manipulation, the tray portion is released from its locked position and is ejected under the action of the resilient spring.

According to one aspect of the present invention there is provided a storage device for rectangular trays, each of the rectangular trays having a front surface and a rear surface and a pair of side ledges extending substantially from the rear surface to the front surface and terminating in respective notches adjacent the front surface, the storage device comprising a plurality of interconnected housing elements, each of the housing elements including a rear wall and two side walls defining a rectangular space for receiving one of the rectangular trays, biasing apparatus adjacent the rear wall for applying a compressive force to the rear surface for urging the tray out of the space, and latch apparatus extending from at least one of the two side walls for releasably engaging one of the notches, thereby retaining the tray in the space against the compressive force.

According to another aspect of the invention there is provided a housing element for storing a compact disc carrying tray, the tray having a front surface and a rear surface and a pair of side ledges extending substantially from the rear surface to the front surface and terminating in respective notches adjacent the front surface, the housing element comprising a rear wall and two side walls defining a rectangular space for receiving the compact disc tray, biasing apparatus adjacent the rear wall for applying a compressive force to the rear surface for urging the tray out of the space, and latch apparatus extending from at least one of the two side walls for releasably engaging one of the notches, thereby retaining the tray in the space against the compressive force.

BRIEF DESCRIPTION OF THE DRAWINGS

A detailed description of the preferred embodiment is provided herein below, with reference to the accompanying drawings, wherein.

DETAILED DESCRIPTION OF THE PREFERRED EMBODIMENT

Figure 1:
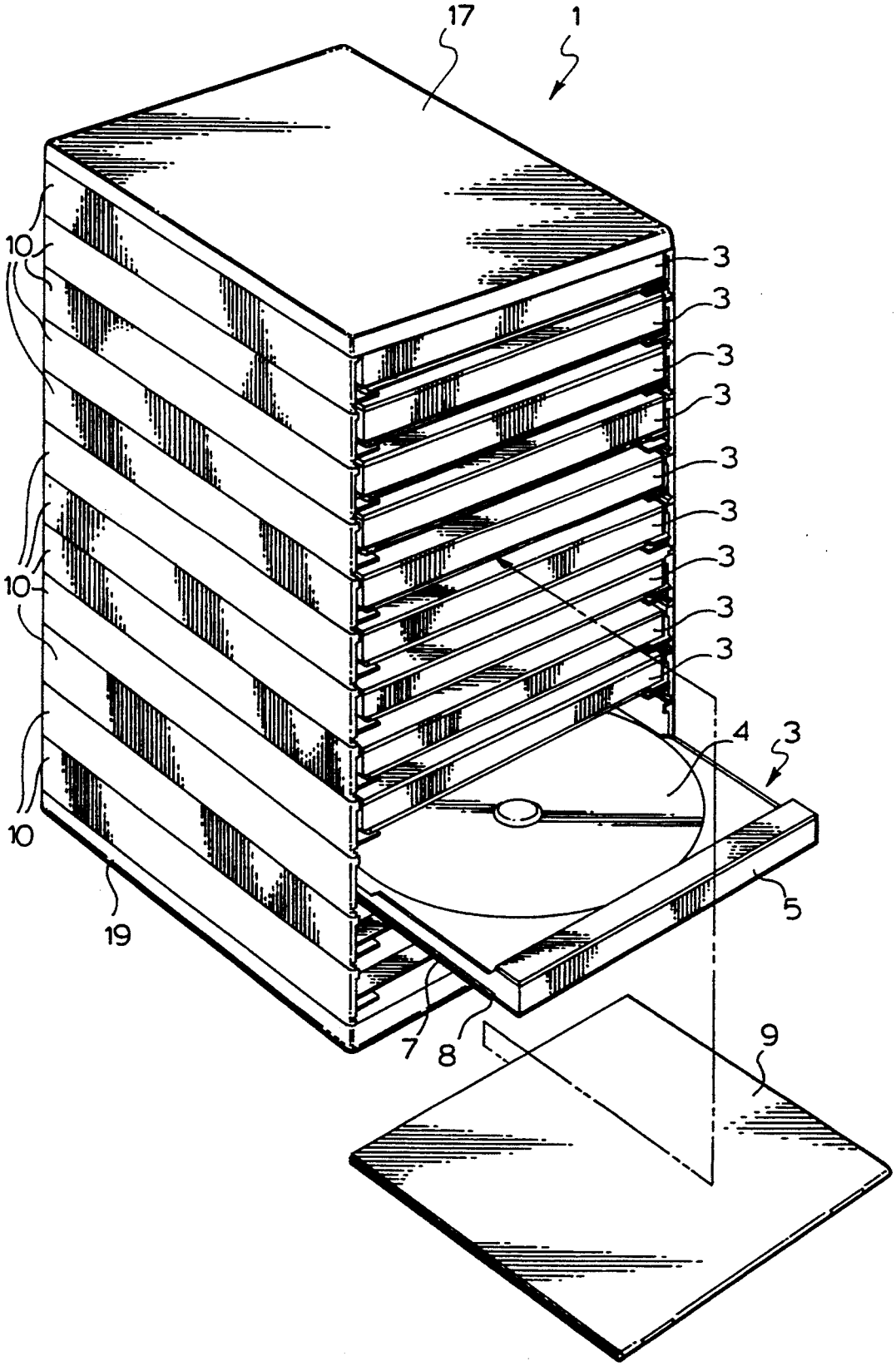
FIG. 1 is a perspective view of a modular storage device according to the present invention.

Referring first to FIGS. 1–9 of the drawings, a modular storage device 1 is shown for storing a plurality of carrying trays 3 for recorded media such as a compact disc 4. Each tray 3 forms part of the conventional compact disc case or jewel box with the lid portion (not shown) discarded. The conventional CD carrying tray 3 comprises a front surface 5 on which title and performer information is normally displayed, a rear surface 6, and a pair of side ledges 7 extending from the rear surface 6 toward the front surface 5 and terminating in respective right angle notches 8.

A lyric sheet 9 or other promotional material which is normally packaged with and retained by the lid portion (not shown) of the conventional compact disc case may be separately stored in the modular storage device 1 beneath the associated compact disc tray 3, as discussed in greater detail below.

The modular storage device 1 comprises a plurality of interconnected modules or housing elements 10 each having a planar top wall 12 having the physical dimensions substantially of the compact disc carrying tray 3, a pair of side walls 14, 16 depending from the top wall 12 and a rear wall 18 also depending from the top wall 12. The rear wall 18 and parallel side walls and 14, 16 define a rectangular space for receiving the compact disc carrying tray 3.

As will be discussed in greater detail below, any number of receptacles or housing elements 10 may be vertically stacked to form the modular storage device 1. A top end unit 17 and bottom end unit 19 are connected respectively to the top most and bottom most, of the housing elements 10 to form an aesthetically pleasing outer surface.

Figures 3A, 3B:
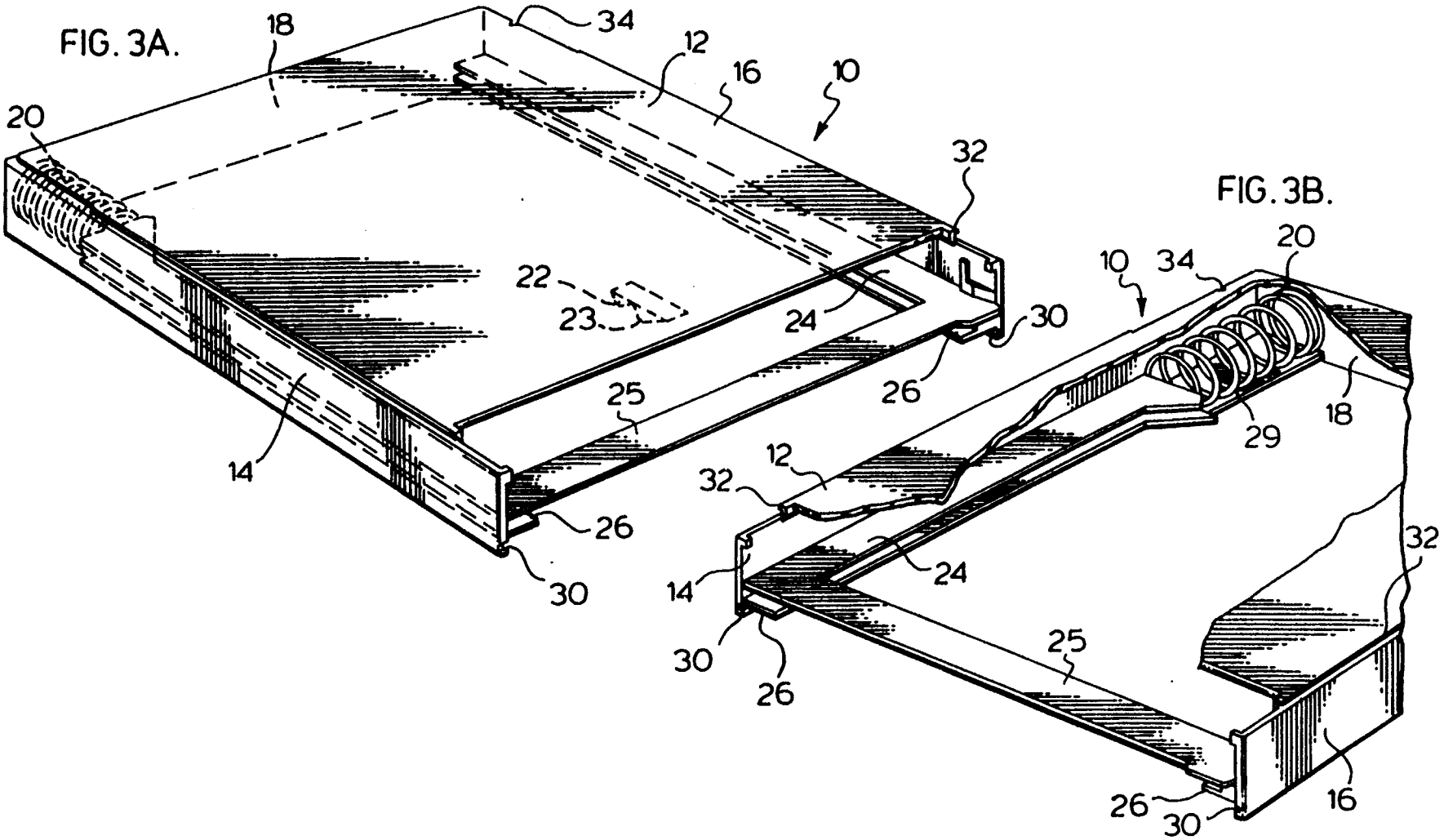
FIGS. 3A and 3B are perspective views of a single receptacle housing element of the storage device according to the preferred embodiment.
Figure 4:
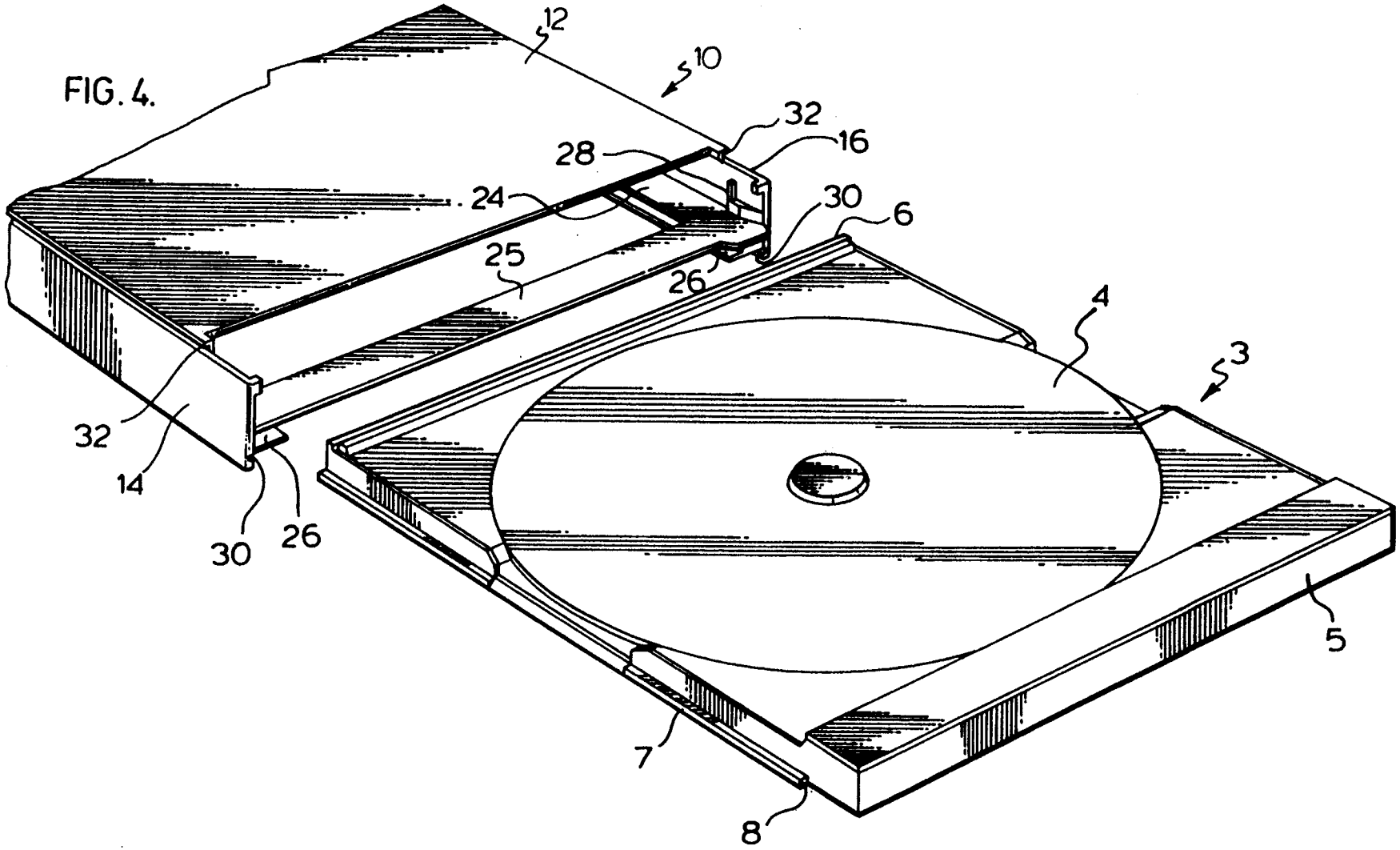
FIG. 4 is a perspective view of a compact disc tray ready for insertion into the receptacle of FIGS. 3A and 3B.
Figure 5:
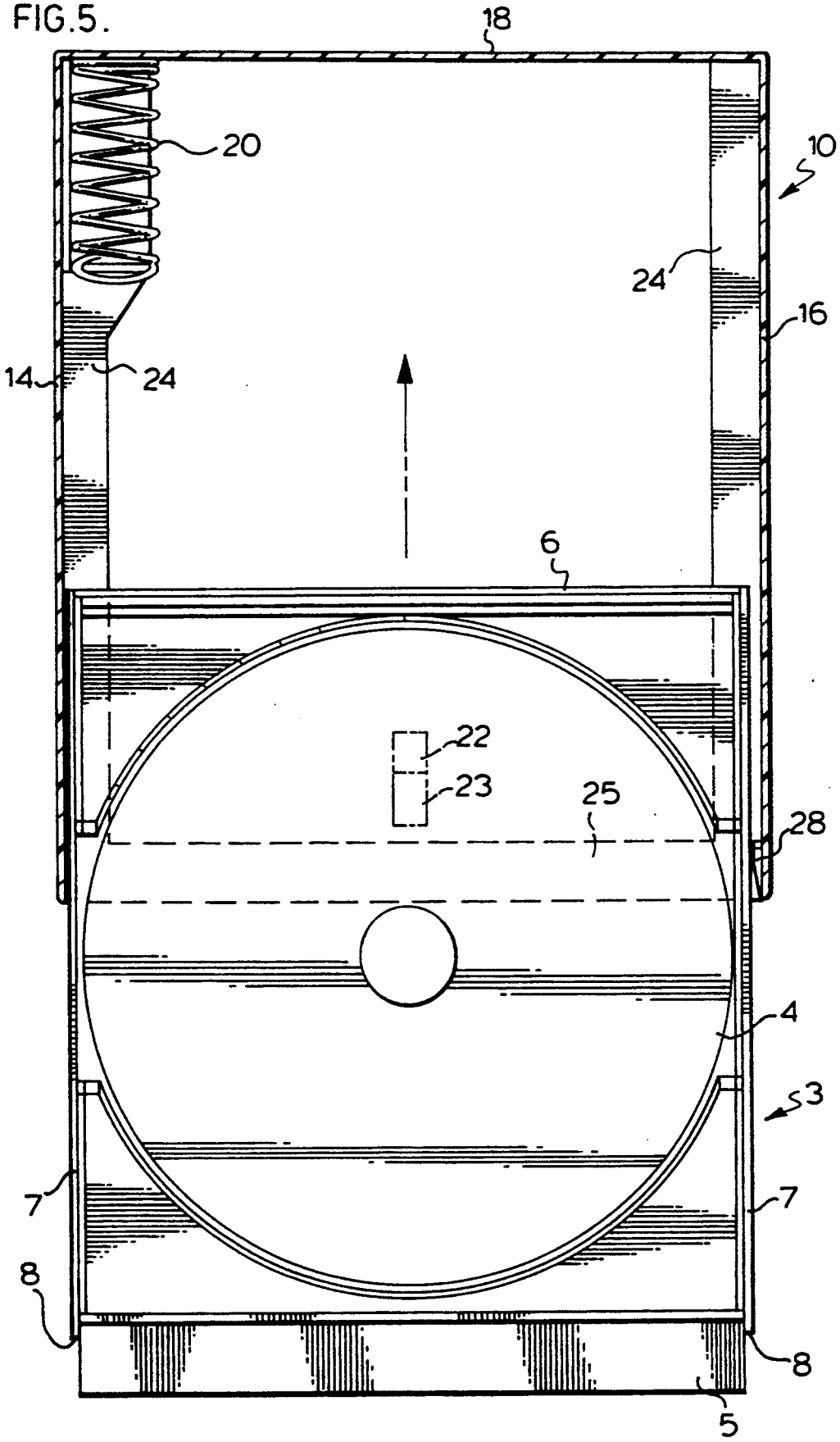
FIG. 5 is a plan view of a compact disc tray being inserted into the receptacle.
Figure 6A:
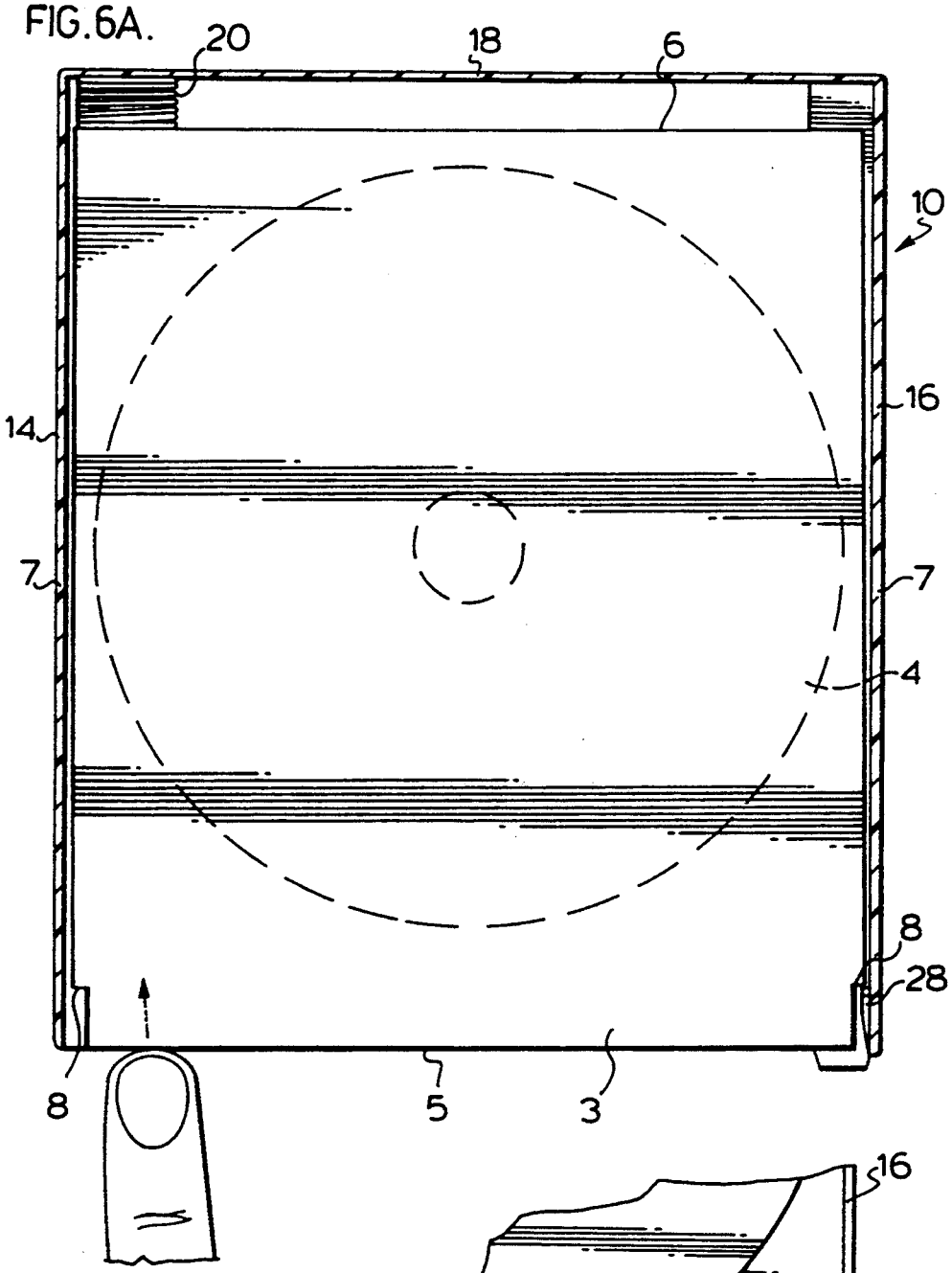
FIG. 6A is a plan view showing a method of inserting the compact disc tray into the receptacle.
Figure 6B:
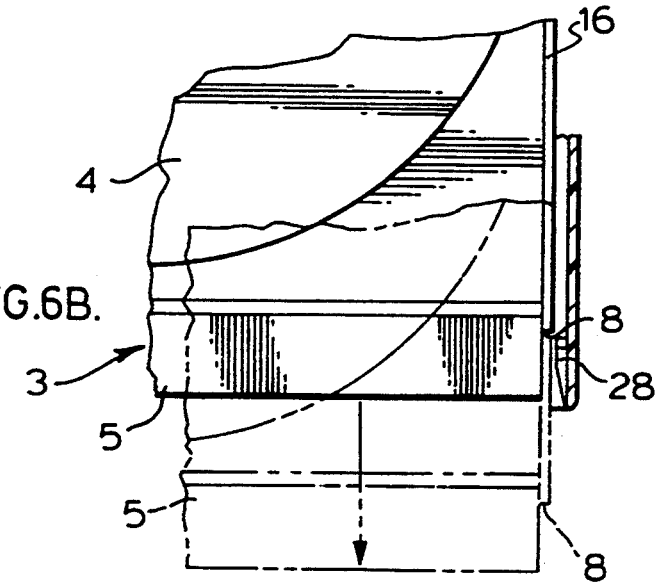
FIG. 6B is a detail showing a latch arrangement for retaining the compact disc tray in the receptacle.

A coil spring 20 or other resiliently-deformable member, is mounted adjacent the rear wall 18 as shown best in FIG. 3B.

A pair of protrusions 22, 23 are formed in the top wall 12 of the housing element 10 so as normally to project below the plane of the top wall 12.

The rear wall 18 has a planar interior. Each of the side walls 14, 16 is provided with a first pair of flanges 24 extending for the length thereof to support and guide the conventional side ledges 7 of the compact disc carrying tray 3. The first pair of flanges 24 are joined at the extreme forward end thereof by a web 25 extending across the forward portion of the housing element 10 parallel to the top wall 12. A second pair of flanges 26 extend inwardly one from each side wall 14, 16 spaced apart beneath the flanges 24 to define a slot between the horizontally aligned pairs of flanges. This slot permits the lyrics or other printed material 9 usually associated with compact discs and usually slide-fitting in the compact disc case lid for storage with the disc. The slot defined between the first and second pairs of flanges 24 and 25 is optional, and may be omitted.

The flanges 24 are located at a physical depth from the top wall 12 which enables the compact disc carrying tray 3 to be received in sliding relation with a sufficiently small gap between the tray 3 and the top wall 12 for inward and outward sliding movement relative to the housing element 10, with the side ledges 7 being supported by the first pair of flanges 24.

A latch or stop element 28 projects from the inner surface of side wall 16 for retaining the disc tray 3 within the housing element 10 by means of engaging the notch 8. In this way, the compact disc tray 3 is retained within the housing element 10 against the compressive force of spring 20, as will be discussed in greater detail below.

In operation the user of the modular storage device of the present invention who is desirous of storing a compact disc within a receptacle of housing element 10, first removes the lid portion of the conventional compact disc case and also removes the lyric sheet 9. The lid portion may then be discarded.

The user inserts the compact disc tray 3 along with compact disc 4 into the rectangular space defined by the side walls 14, 16, rear wall 18 and top wall 12 of the receptacle or housing element 10. Upon inserting the tray 3, the top edge of the rear wall 18 first must be forced past the larger protrusion 23 in top wall 12 and thereafter by the smaller protrusion 22. The orientation of disc tray 3 to housing element 10 is shown best with reference to FIGS. 4, 5, 6 and 7.

As the tray 3 slides along the first pair of flanges 24 into the receptacle or housing element 10, the rear wall 18 of the tray engages the spring 20 and deforms the same. When the compact disc tray 3 is located wholly within the confines of the housing element 10, the notch 8 formed in the right side ledge 7 of the compact disc tray 3 is received behind the latch 28 (see FIGS. 6A and 6B).

The resilient action of the spring 20 tends to hold the notch 8 against the latch 28 so that the compact disc tray 3 is received in the housing element 10 in a locked position. To that end, the compression or coiled spring 20 is preferably located diagonally opposite the stop element or latch 28 so that compressive force is applied to the tray 3 outwardly and to the right relative to the housing 10 so that the notch 8 is also urged forwardly and to the right towards latch 28. The top wall 12 encloses the compact disc tray 3 and hence replaces the conventional hinged lid when the CD carrying tray 3 is stored within the housing element 10.

The compact disc tray 3 is readily released for access to the disk 4 contained therein by single manipulation of the tray 3 for disengaging the notch 8 from the stop element or latch 28, whereupon the spring 20 ejects the tray 3 partly outward from the housing element 10. The tray 3 then may be drawn further out against the stop action of the first protrusion 22, whereupon the disc 4 may be removed from or replaced in the tray 3 without any necessity for the tray to be pulled all the way out of the housing element 10. More particularly, as shown with reference to FIG. 7A, the top edge of the rear surface 6 of compact disc tray 3 rides over the smaller protrusion 22 upon slight flexure of the top wall 12 so as to rest between the two protrusions 22 and 23. The greater thickness of protrusion 23 inhibits removal of the tray 3 from the housing element, but permits the compact disc 4 to be removed and subsequently replaced.

Furthermore, upon decompression of spring 20, the lyric sheet 9 is also partially ejected from the slot defined by the first and second parallel flanges 24 and 26 (FIG. 7A) so that the lyric sheet 9 may also be easily grasped for removal from housing element 10.

According to one contemplated embodiment, the compact disc 4 may be packaged for distribution and sale in combination with the tray 3 and housing element 10 (i.e. the rear surface 6 of the tray 3 can be positioned between the two protrusions 22, 23 and then shrink wrapped with the lyric sheet or other printed matter 9 inside. This arrangement can be used to replace the conventional cardboard long box.

Figure 7A:
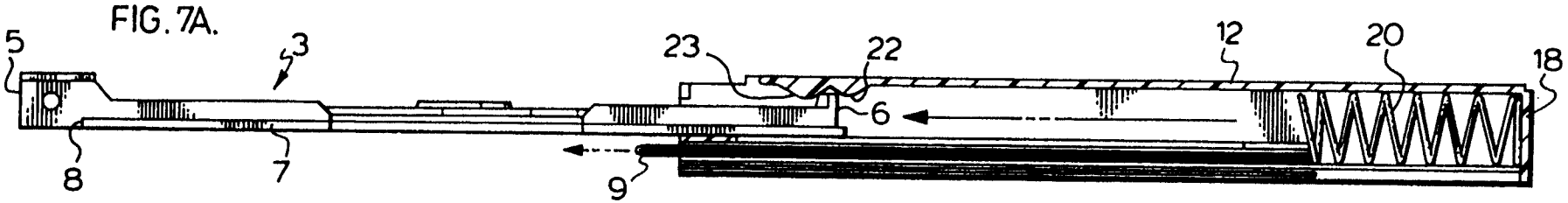
FIGS. 7A and 7B are side cross-sectional views of the receptacle with compact disc tray in released and retained positions.
Figure 7B:
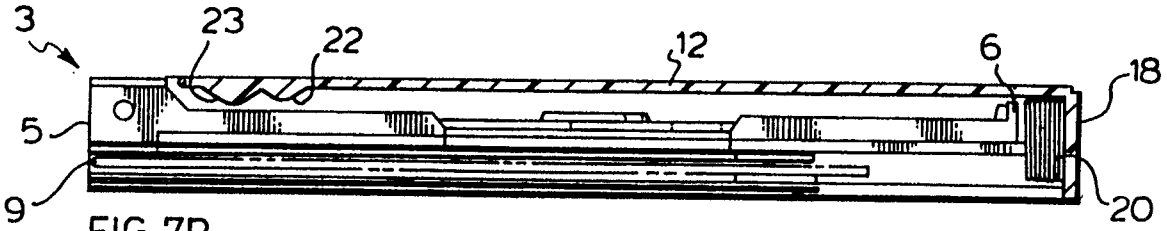
Figure 8:
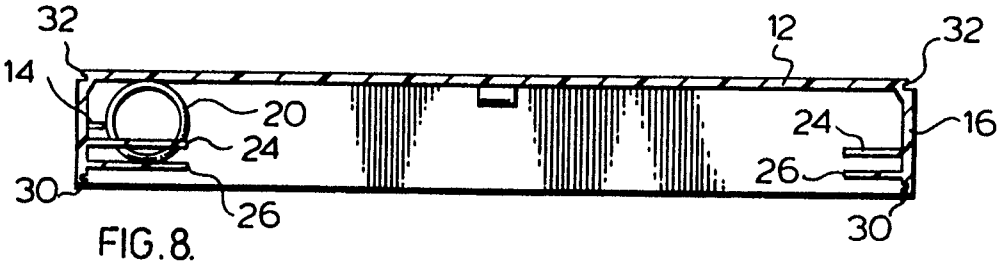
FIG. 8 is a front elevation cross-sectional view of the receptacle according to the preferred embodiment.
Figure 9:
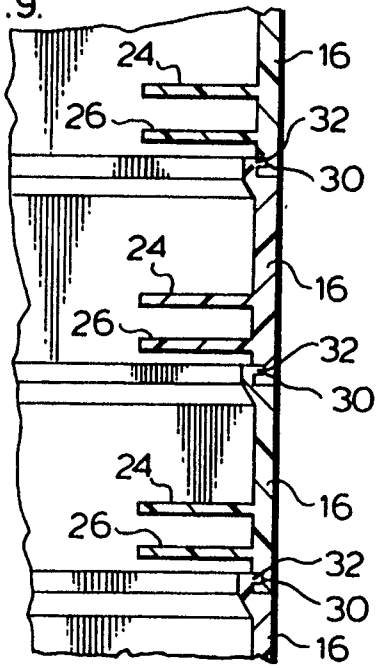
FIG. 9 is a detail of a cross-sectional front elevation view of multiple receptacles in modular stacked arrangement according to the preferred embodiment.

The front portion of the top wall 12 is cut away so that the upwardly extending front surface 5 of the tray 3 lies flush against the top wall 12 when the tray is locked inside the housing element 10, as shown in FIG. 7B.

The insertion and removal of compact discs from the housing element 10 can be readily achieved using a single hand, thereby overcoming the problem of conventional compact disc cases which requires the use of two hands to remove and insert compact discs.

The housing element 10 may be formed of any convenient material, such as rigid polymeric material and may be formed as a one-piece molded element, with which the spring 20 is subsequently assembled between the rear wall 18 and the rear portion of the left side first and second flanges 24, 26, supported on a ledge 29 which is an extension of the flange 26 (FIG. 3B).

Figure 2:
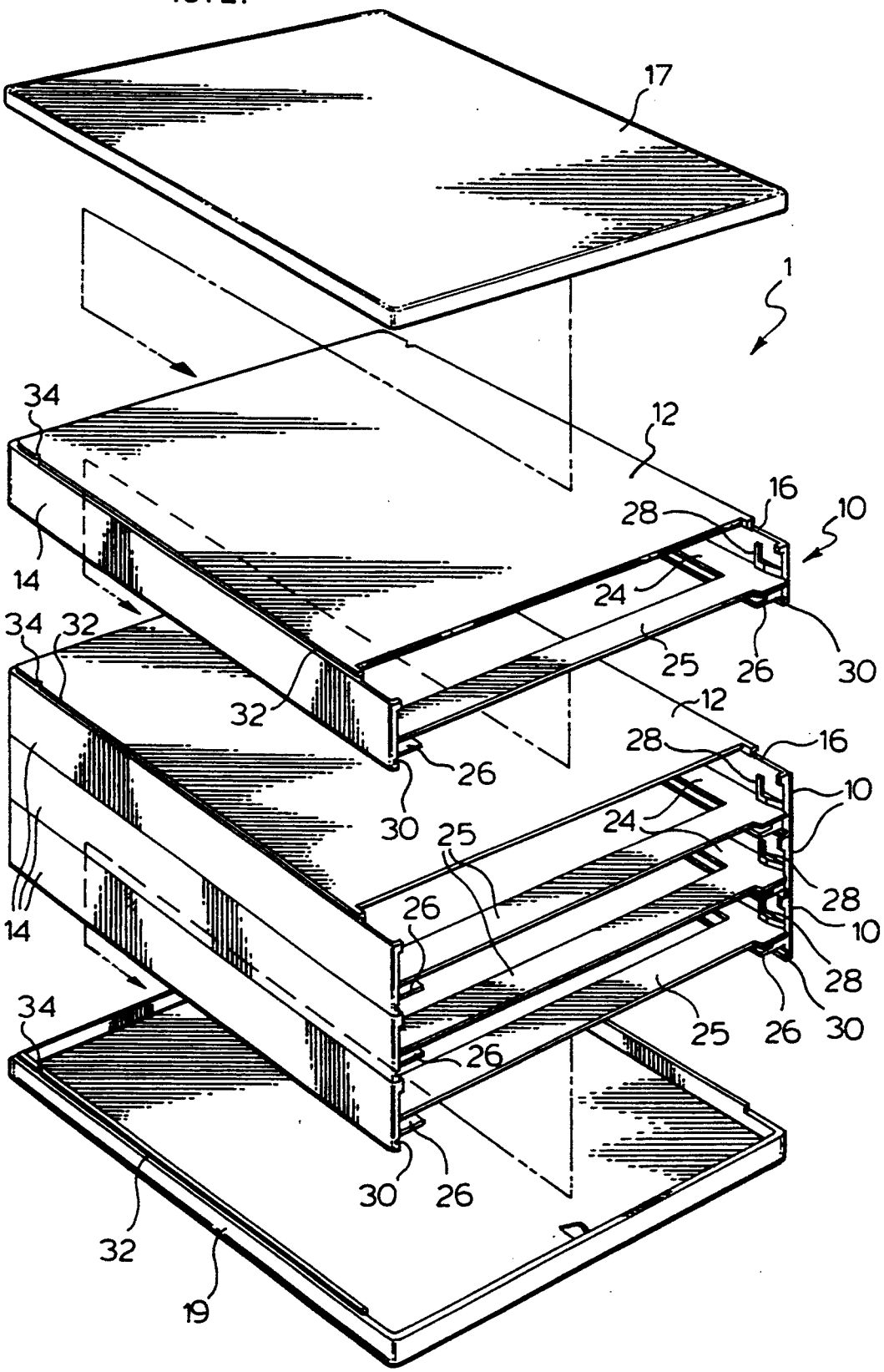
FIG. 2 is an exploded view showing connection of the modular receptacles forming the container of the present invention.
Figure 10A:
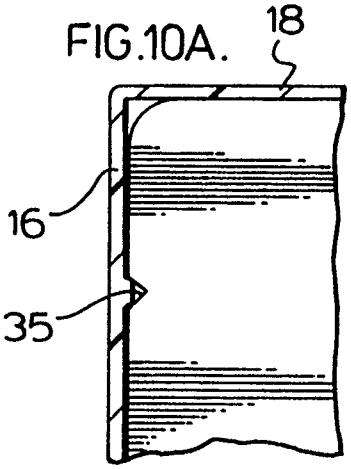
FIGS. 10 and 10A illustrate structured features of the receptacles by which they may be stacked.
Figure 10:
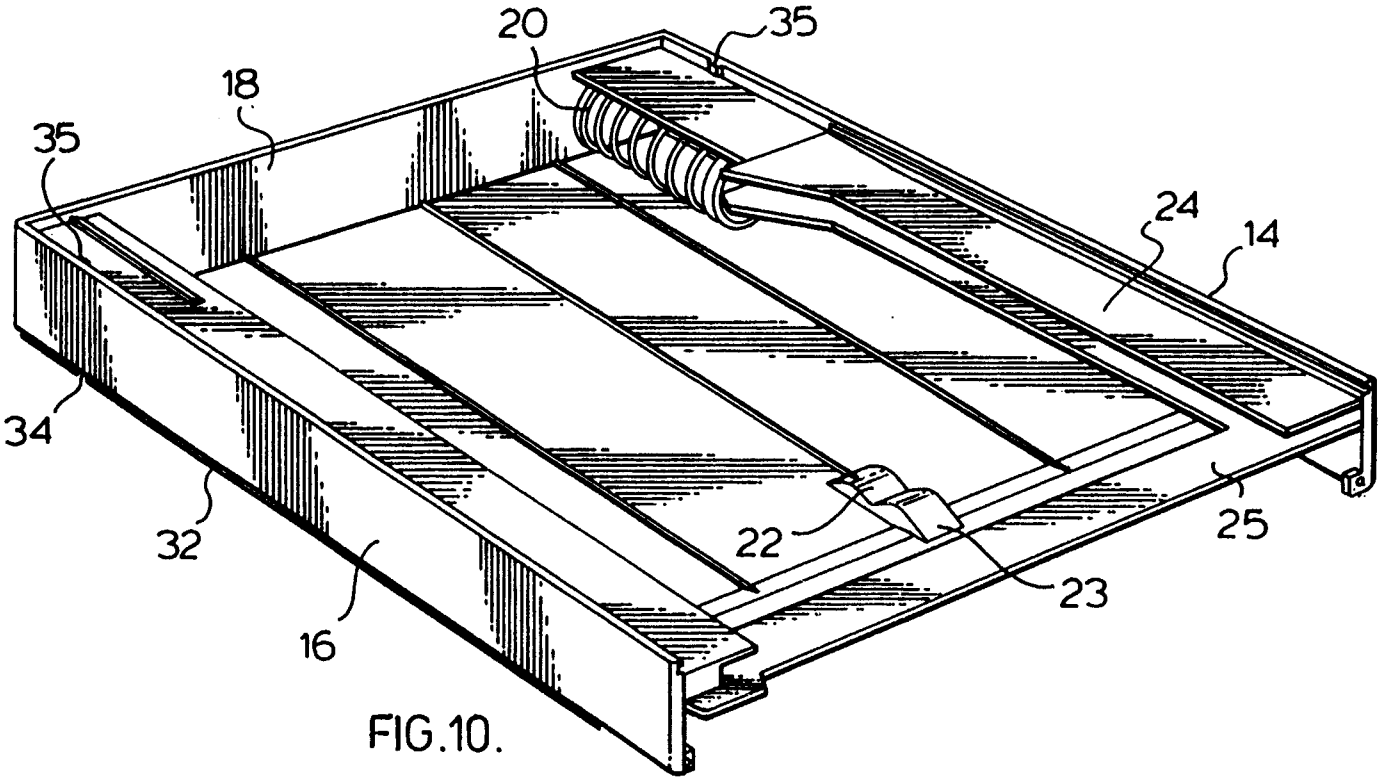

The housing element 10 is constructed to be assembled with other like elements as shown in FIGS. 1 and 2 for convenience of storage of multiple numbers of compacts discs. For this purpose, a further pair of grooves 30 are provided in the bottom of side walls 14, 16 so as to open inwardly of the housing element 10 and a further pair of flanges 32 are provided in top wall 12. The grooves 30 and flanges 32 are complimentary and interfitting, so that housing elements 10 can be mounted in keyed sliding fit relationship one with another (FIG. 2). A pair of grooves 30 is also provided in the top end unit 17, and a pair of flanges 32 is provided in the bottom end cap 19 to serve a similar function. As shown in FIGS. 10 and 10A, each of the flanges 32 also incorporates a detent 34 adjacent the rear wall 18, and each of the grooves 30 incorporates a protrusion 35 adapted to engage with each detent 34 for locking respective ones of the housing elements 10 as well as end units 17 and 19 firmly in place.

Figure 11:
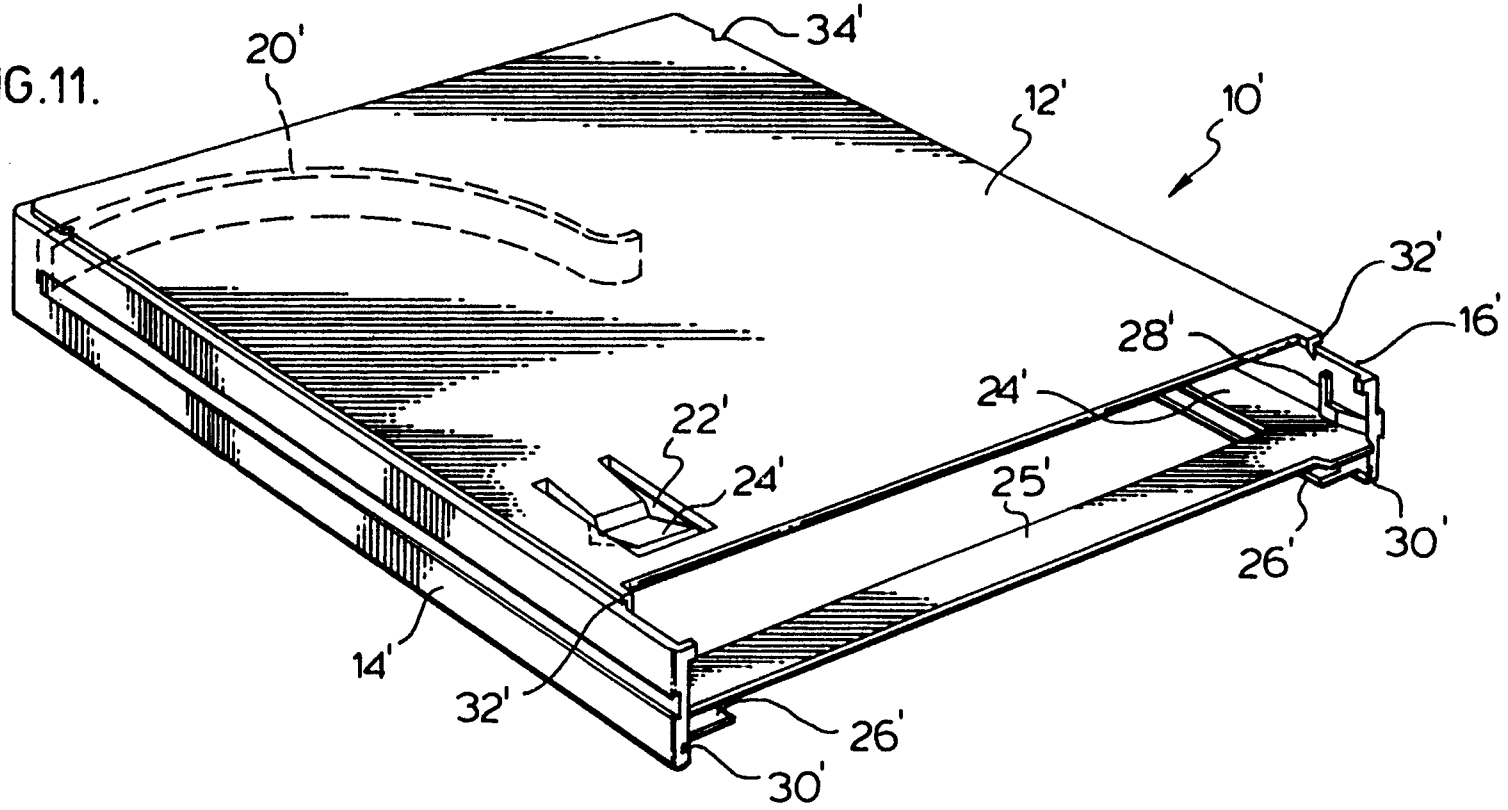
FIG. 11 is a perspective view of a receptacle according to a first alternative embodiment.

Turning to the embodiment of FIG. 11, there is illustrated a housing element 10' similar to the housing element 10 described with respect to FIGS. 1–10, like reference numerals denoting like elements between the two embodiments.

The embodiment of FIG. 11 differs from the embodiment of FIGS. 1–10 primarily in that the coil or compression spring 20 is replaced with a leaf spring 20' mounted adjacent the rear wall. A recess 22' is formed in the top wall 12' and a further leaf spring 24' or other resiliently-deformable member is mounted to the top wall 12' so as normally to project below the plane of the top wall 12' but be deformable into the recess 22'

As in the embodiment illustrated in FIGS. 1–10 the first pair of flanges 24' are located at a physical height from the top wall 12' which enables a compact disc carrying tray (not shown in FIG. 11) to be received in sliding relation with a sufficiently small gap between the tray and the top wall 12', that the top edge of the rear surface of the tray engages and deforms the spring 24' upwardly After the top edge has passed the spring 24', the latter resiliently resumes its rest position, not located within the tray, and therefore inhibits removal of the tray from the housing element 10'.

As the tray slides on the flanges 24' the end wall of the tray engages the spring 20' and deforms the same. When the compact disc tray is located wholly within the confines of the side walls 14' and 16' the notch which is formed in the side ledges of the conventional compact disc tray is received behind a stop element 28' projecting from side wall 16'.

The resilient action of the spring 20' tends to hold the notch against the stop element 28', so that the compact disc tray is received in the housing element 10' in a locked position.

The compact disc tray is readily released for access to the disc contained therein by simple manipulation of the tray to release it from the stop element 28', whereupon the spring 20' ejects the tray a portion of the way out from housing element 10'. The tray then may be drawn further out, against the stop action of the spring 24' whereupon the disc may be removed from or replaced in the tray without any necessity for the tray to be pulled all the way out of the housing element.

Accordingly, the modular storage device 1 of the present invention provides not only a convenient, inexpensive and easy to use housing for individual compact discs, but provides a modular structure which enables a module of any dimension of such units to be assembled in a vertical stacked arrangement with aesthetically pleasing end units.

Modifications are possible within the scope of the present invention. For example, side wall 14 (or side wall 16) may be provided with a projecting elongate tongue element while the other of the side walls 16 (or alternatively side wall 14) may be provided with a groove of complimentary shape to the tongue element on side wall 14 to receive the tongue element of another housing element 10 for sliding fit relationship, so as to assemble a plurality of housing elements 10 in side-abutting relationship. In this alternative embodiment, the various tongue-and-groove elements may also be used to provide external trim to the housing elements 10, so as to enclose the various faces of the housing element, except for the front, where access to the disc is required. Suitable trim elements may be fabricated of molded rigid plastic material.

Figure 12:
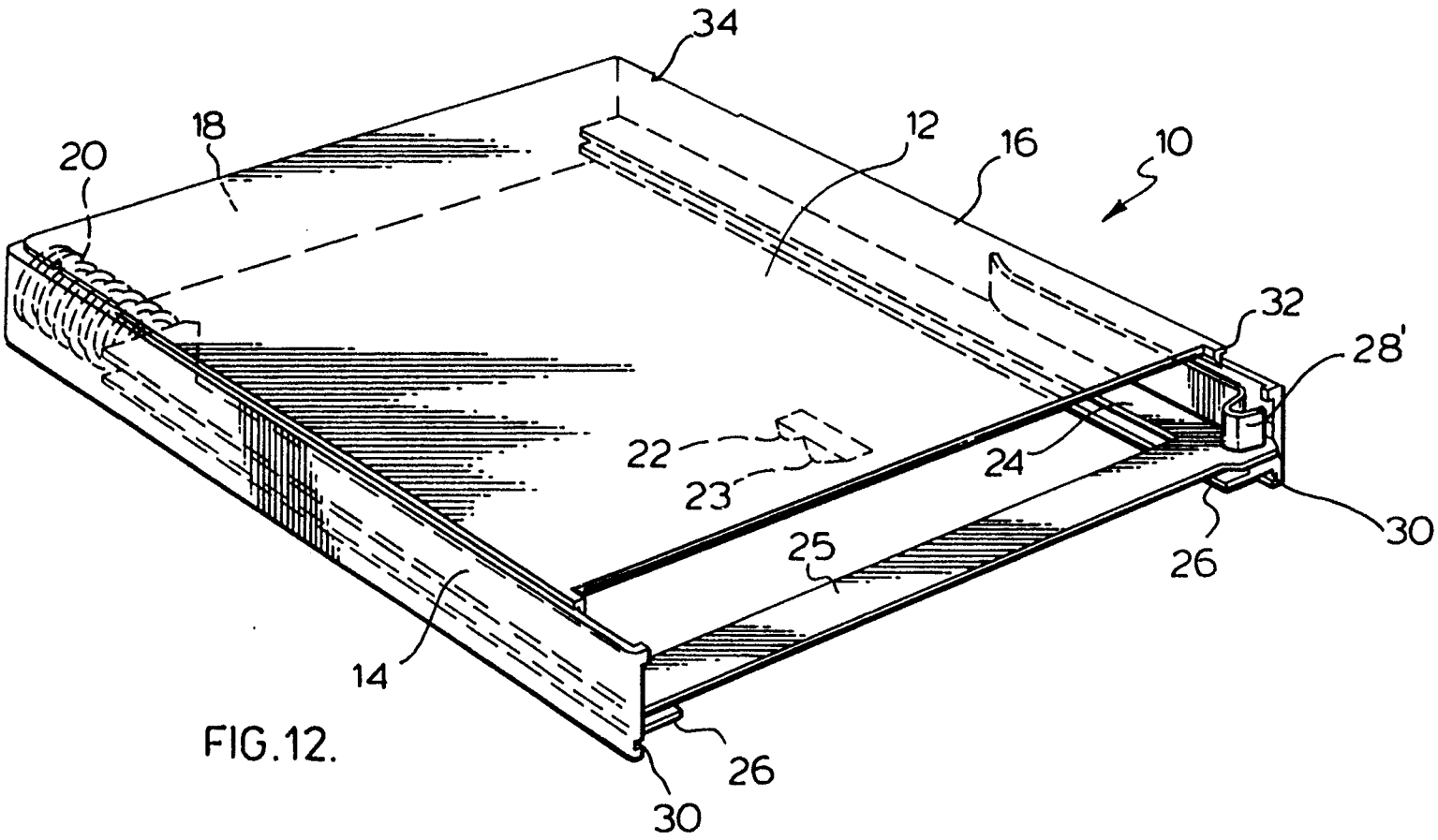
FIG. 12 is a perspective view of a receptacle according to a second alternative embodiment.

According to a further alternative embodiment shown in FIG. 12, a spring-loaded locking mechanism 28' may be employed in place of the stop element or latch 28 of FIGS. 1–11 to hold the tray 3 in the housing element 10. The resilient action of such a spring-loaded locking mechanism may be adapted to hold the forward part of the tray 3 against the outward force of spring 20.

The compact disc tray is readily released for access to the disc contained therein by manipulation of latch 28', whereupon the spring 20 ejects the tray a portion of the way out of the housing element 10. The tray may then be drawn further out, against the stop action of the protrusions 22 and 23, whereupon the disc may be removed from or replaced in the tray.

Furthermore, although the preferred embodiment of the invention is disclosed as being provided for the storage of compact discs, other recorded or recording material may be accommodated. For example, 8 mm cassettes, standard audio cassettes, CD-ROM cartridges, etc., may be stored in the device of the present invention provided that the associated carrying trays incorporate a pair of side ledges terminating in respective notches for engagement with the latch 28 of the housing element 10.

Other modifications and embodiments are possible within the scope of the invention as defined by the claims appended hereto.

I claim:

1. A storage device for rectangular trays and associated printed material, each of said rectangular trays having a front surface and a rear surface and a pair of side ledges extending substantially from said rear surface to said front surface and terminating in respective notches adjacent said front surface, said storage device comprising a plurality of interconnected housing elements, each of said housing elements including a rear wall and two side walls defining a rectangular space for receiving one of said rectangular trays, biasing means adjacent said rear wall for applying a compressive force to said rear surface for urging said tray out of said space, latch means extending from at least one of said two side walls for releasably engaging one of said notches, thereby retaining said tray in said space against said compressive force, and exactly two pairs of flanges, a first one of said two pairs of flanges extending from respective ones of said two side walls for supporting and guiding said pair of side edges into and out of said space, whereby said trays may be opened and closed relative to said housing elements for providing access thereto, and a second one of said two pairs of flanges extending from respective ones of said two side walls parallel to said first pair of flanges for receiving a sheet of said printed material.

2. The storage device of claim 1 wherein said biasing means is a coil spring supported by one of said first pair of flanges adjacent said rear wall.

3. The storage device of claim 1 wherein said biasing means is a leaf spring connected to one of said first pair of flanges adjacent said rear wall.

4. The storage device of claim 1 wherein each of said housing, elements further includes a rectangular top wall for covering said rectangular space.

5. The storage device of claim 4 further including a recess in said top wall and a resiliently-deformable member mounted to said top wall so as to project below the plane of said top wall through said recess for engaging said rear surface of the tray to inhibit removal thereof from said housing element.

6. The storage device of claim 4 wherein each of said housing elements includes a further pair of flanges extending from said top wall and a pair of grooves in said two side walls for receiving said further pair of flanges whereby said plurality of interconnected housing elements may be stacked.

7. The storage device of claim 6 further including a pair of detents in said further pair of flanges adjacent said rear wall, and a pair of protrusions from each of said two side walls adapted to be received in said pair of detents for locking said plurality of interconnected housing elements in place.

8. The storage device of claim 1 wherein said latch means comprises a generally L-shaped projection from said at least one of said two side walls and a ramp portion extending from said generally L-shaped projection to said at least one of said two side walls.

9. The storage device of claim 1 further including at least one end unit connected to said plurality of interconnected housing elements for providing an aesthetically finished outward appearance to said storage device.

10. The storage device of claim 1 wherein said rectangular trays are conventional compact disc carrying trays.

11. The storage device of claim 1 wherein said biasing means and said latch means are disposed diagonally opposite each other relative to said rectangular space, 12. A housing element for storing a compact disc carrying tray and associated sheet of printed material, said tray having a front surface and a rear surface and a pair of side ledges extending substantially from said rear surface to said front surface and terminating in respective notches adjacent said front surface, said housing element comprising a rear wall and two side walls defining a rectangular space for receiving said compact disc tray, biasing means adjacent said rear wall for applying a compressive force to said rear surface for urging said tray out of said space, latch means extending from at least one of said two side walls for releasably engaging one of said notches, thereby retaining said tray in said space against said compressive force, and exactly two pairs of flanges, a first one of said two pairs of flanges extending from respective ones of said two side walls for supporting and guiding said pair of side edges into and out of said space, whereby said tray may be opened and closed relative to said housing element for providing access to a compact disc carried thereby, and a second one of said two pairs of flanges extending from respective ones of said two side walls parallel to said first pair of flanges for receiving said sheet of printed material.

13. The housing element of claim 12 wherein said biasing means is a coil spring supported by one of said first pair of flanges adjacent said rear wall.

14. The housing element of claim 12 wherein said biasing means is a leaf spring connected to one of said first pair of flanges adjacent said rear wall.

15. The housing element of claim 12 further including a rectangular top wall for covering said rectangular space.

16. The housing element of claim 15 further including at least one protrusion from said top wall below the lane of said top wall adjacent a front portion of said housing element for engaging said rear surface of the tray to inhibit removal thereof from said housing element.

17. The housing element of claim 15 further including a recess in said top wall and a resiliently-deformable member mounted to said top wall so as to project below the plane of said top wall through said recess for engaging said rear surface of the tray to inhibit removal thereof from said housing element.

18. The housing element of claim 12 further including a web portion connecting each of said first pair of flanges.

19. The housing element of claim 12 wherein said biasing means and said latch means are disposed diagonally opposite each other relative to said rectangular space, such that said compressive force is directed both outwardly of said rectangular space and toward said at least one of said two side walls for urging said one of said notches toward said latch means.

* * * * *